US005474191A

United States Patent [19]

Bergeron et al.

[11] Patent Number: 5,474,191

[45] Date of Patent: Dec. 12, 1995

[54] GOLF CADDY

[75] Inventors: Robert J. Bergeron, Whittier; Anthony V. Germano, Desept Hot Springs, both of Calif.

[73] Assignee: Cadi Pro, Inc., Maplewood, N.J.

[21] Appl. No.: 172,719

[22] Filed: Apr. 28, 1994

[51] Int. Cl.[6] ..... A63B 55/00

[52] U.S. Cl. ..... 211/70.2; 206/315.2; 206/315.9; 248/156; 248/162.1; 248/532

[58] Field of Search ..... 211/70.2, 14, 120; 248/530, 532, 156, 162.1, 406.2; 206/315.2, 315.6, 315.9

[56] References Cited

U.S. PATENT DOCUMENTS

| | | | |
|---|---|---|---|
| 699,391 | 5/1902 | Johnson | 206/315.2 X |
| 1,625,856 | 4/1927 | Judd | 211/14 |
| 2,091,298 | 8/1937 | Agnew | 211/70.2 X |
| 2,367,234 | 1/1945 | Mitchell | 206/315.2 |
| 2,577,333 | 12/1951 | Klum et al. | 211/70.2 |
| 2,674,426 | 4/1954 | Hiler | 248/532 X |
| 2,846,077 | 8/1958 | Kozub | 211/14 |
| 3,043,437 | 7/1962 | Lockie | 211/60 |
| 3,966,051 | 6/1976 | Hollister et al. | 211/70.2 X |
| 4,753,446 | 6/1988 | Mills | 211/70.2 X |
| 5,080,239 | 1/1992 | Rowland | 211/70.2 |
| 5,222,703 | 6/1993 | Ricciardilli | 248/532 X |
| 5,314,079 | 5/1994 | Young | 211/70.2 |

*Primary Examiner*—Ramon O. Ramirez
*Assistant Examiner*—Korie H. Chan
*Attorney, Agent, or Firm*—William Squire

[57] ABSTRACT

An aluminum tube has a rubber grip on one end and a golf club support made of thermoplastic ABS material at the other end. The support has an annular array of cup shaped receptacles for receiving the grip end of a golf club, one of the receptacles being larger than the others to receive a putter. The support has a depending central member with a through bore having an internal shoulder against which the tube abuts. The bore has a threaded end for receiving a spike for insertion into earth during a golf game. The support has a second threaded hole for securing the spike when not in use. A counterweight, i.e., a bolt with a head, is wedged within the tube and support with the bolt head abutting the shoulder to balance the caddy. A handle is secured to the tube at the approximate center of gravity of the caddy when the clubs are attached for carrying the caddy in a balanced mode horizontally. An array of ball clips are attached to the tube axially aligned with the handle for securing golf balls to the tube. A golf club shaft retainer has an annular array of shaft clips for securing the club shafts to the tube near the grip end of the tube.

17 Claims, 1 Drawing Sheet

GOLF CADDY

SUMMARY OF INVENTION

This invention relates to golf equipment carriers for supporting and carrying golf clubs, balls and tees during the game of golf.

A golf club carrier and stand caddy according to the present invention wherein the golf clubs each comprise a shaft having a grip end and a head end, comprises a pole member extending in an axial direction and having upper and lower ends, at least the lower end having a hollow core. An annular golf club support extends radially outwardly from the pole member adjacent to the pole member lower end, the support having an annular array of axially directed receptacles each for receiving and supporting the grip end of a shaft, the array being positioned circumferentially about the pole member. A tubular member having a bore depends centrally the support a distance beyond the receptacles beyond the lower end. A shaft retainer is secured to the pole member at a region intermediate the upper end and support for releasably receiving the supported club shafts in the annular array. A counterweight is secured to the support and to the pole member in the pole member core and in the projecting member bore at the lower end for providing a center of gravity for the stand and carried clubs at a position intermediate the retainer and support.

In one embodiment, the projection member includes means for releasably receiving an axially extending spike for securing the caddy in earth.

In a further embodiment, the support comprises a disk having the receptacles, the depending tubular member being central the disk for supporting the caddy in an upright orientation.

In a further embodiment, the tubular member bore has an upper portion of a first diameter for receiving the pole member and a smaller diameter lower portion for releasably receiving the spike, the counterweight being received in the pole member core coextensive with at least a portion of the bore.

In a still further embodiment, the counterweight comprises a bolt, the tubular member bore having a shoulder between the upper and lower portions, the bolt and pole member abutting the shoulder.

In a further embodiment, a carrying handle is fixedly secured to the pole member in a medial region of the pole member, the caddy and the carried clubs having a center of gravity approximately at the medial region.

In a still further embodiment, a resilient hand grip is secured to the pole member upper end.

In a further embodiment, the handle extends in the axial direction aligned with an axially extending array of golf ball clips.

IN THE DRAWING

DETAILED DESCRIPTION

Figure 1:
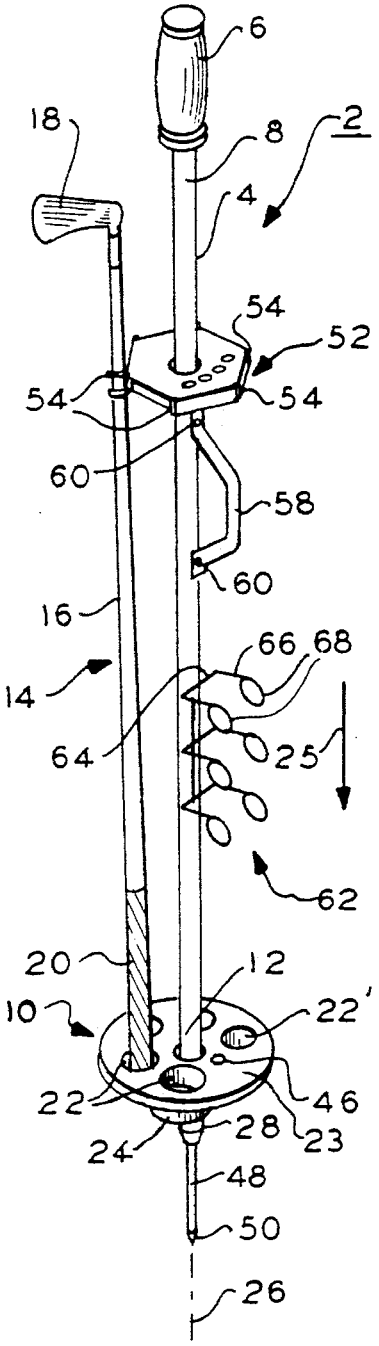
FIG. 1 is an isometric view of a golf equipment caddy in an active mode in which a spike is positioned for insertion into the earth for supporting the caddy during use according to one embodiment of the present invention.

In FIG. 1, caddy 2 comprises a preferably hollow aluminum pole-like tube 4, which may be 42 inches long and formed of 0.75 inch outer diameter and 0.62 inch inner diameter tubing. The tube 4 outer surface may be anodized in different colors.

A resilient rubber hand grip 6 is secured to the upper end 8 of the tube 4.

A golf club 14 comprises a shaft 16 having a golf ball driving head 18 at one end and a handle grip 20 at the opposite end. The handle grips of the different clubs may have different dimensions. For example, a putter may have a grip diameter of 0.0160 inches and the other clubs a 0.130 inch diameter grips.

A lower golf club shaft disk-like support 10, preferably molded thermoplastic material, which may be ABS high impact plastic material, is secured to the lower end 12 of the tube 4. Art annular array of club handle grip 20 receiving cup shaped receptacles 22 are formed in disk flange 23 of the support. Preferably, there are four receptacles provided. Each receptacle includes a lower depending portion 24 extending in an axial direction 25, axis 26. One of the receptacles 22' has a diameter larger than the other receptacles for accommodating a putter grip.

Figure 3:
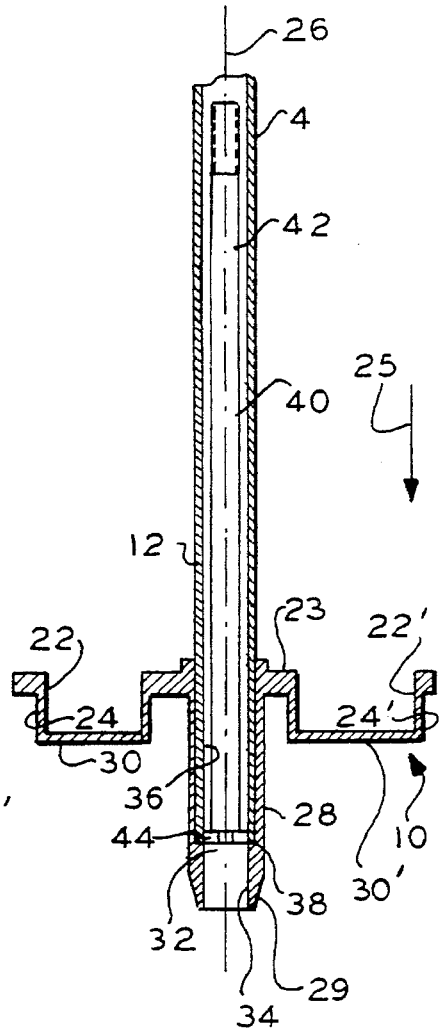
FIG. 3 is a sectional fragmentary elevation view of the lower portion of the caddy of FIG. 2.

In FIG. 3, the support 10 includes a central depending member 28. The member 28 extends beyond the lower most bottoms 30 of the receptacles 22 in the axial direction 25. The member 28 has a conical lower section 29. The member 28 has a through bore 32 coaxial with axis 26. The bore 32 has a lower portion 34 of smaller diameter than upper portion 36. The upper portion 36 and lower portion 34 form a radially inwardly extending annular shoulder 38 therebetween. The bore 32 lower portion 34 is threaded. In FIG. 1, a threaded bore 46 in flange 23 has the identical threads as portion 34 of the member 28 bore 32.

The tube 4 end is fitted into the bore portion 36 and secured thereto. The lower end 12 end edge of the tube 4 abuts the shoulder 38. A counterweight 40, preferably a bolt, has a shaft 42 and a head 44. The head 44 abuts the shoulder 38. The shaft 42 extends upwardly beyond the support 10 in the core of the tube 4. The counterweight 40 preferably comprises a ⅜ inch bolt with a 9/16 inch head. The bolt is forced into the tube 4 core and secured by wedging in place. The support 10 shoulder 38 locks the bolt counterweight 40 in place. The counterweight 40 serves to balance the weight of the clubs such as club 16 and other equipment secured to the caddy 2 in a manner to be described below in more detail.

Figure 2:
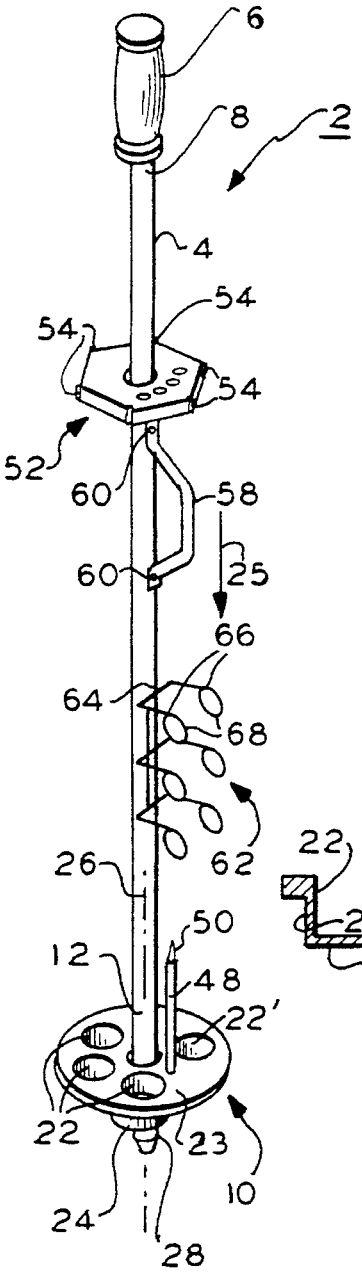
FIG. 2 is an isometric view of the caddy of FIG. 1 wherein the spike is positioned in a quiescent mode when the caddy is not in use.

In FIGS. 1 and 2, a spike 48 has a pointed end 50 for insertion into earth for supporting the caddy 2 in an active mode in use during a game of golf. The spike 48 has a threaded end which attaches to the threads of the bore 32 portion of the member 28 in the active mode. The spike is unthreaded from the member 28 and attached to the threads of bore 46 of the support 36 flange 23 in the quiescent mode, FIG. 2. In this mode the depending member 28 serves to support the caddy when not in use on a golf course during the golf game. The conical portion 28 of the member 28 thus serves as a caddy support in this mode. The spike 48 may be ⅜ inch diameter and five inches long.

A golf club shaft retainer 52, FIGS. 1 and 2, is secured to the tube 4 at the tube upper end 8. The retainer is preferably molded nylon. The retainer has an annular array of golf club retaining clips 54. There may be five clips 54 one of which is extra, the remaining being aligned axially along axis 26 with the receptacles 22 and 22'. This alignment is illustrated by the position of club 14, FIG. 1.

An array of apertured rubber grommets 56 are attached to the retainer 52 for receiving corresponding golf tees (not shown).

A carrying handle 58 is secured to the tube 4 by screws 60 approximately at the axial position corresponding to the center of gravity of the caddy 2 with the golf clubs and other equipment to be described below attached. This position of the handle 58 permits the carrying of the caddy horizontally with respect to the force of gravity in a balanced manner to permit ease of carrying.

An axially extending array of golf ball securing clips 62 is secured to the tube 4 axially aligned with the handle 58. The clips 62 are formed of wire and are U-shaped with a base 64 fastened to the tube 4 and two legs 66. The legs 66 each have a circular portion 68 and are spaced apart to resiliently grip a golf ball therebetween. The axial alignment of the golf balls with the handle 58 on the same side of the tube 4 permits the golfer holding the handle 58 with one hand to grasp and remove a ball easily with the other hand.

We claim:

1. A golf club carrier and stand caddy for carrying a plurality of golf clubs, the golf clubs each comprising a shaft having a grip end and a head end, said caddy comprising:

a pole member extending in an axial direction and having upper and lower ends, at least the lower end having a hollow core;

an annular golf club support extending radially outwardly from the pole member adjacent to the pole member lower end, said support having an annular array of axially directed receptacles each for receiving and supporting the grip end of a carried club shaft, said array being positioned circumferentially about the pole member;

a tubular member having a bore depending centrally from said support a distance beyond said receptacles and beyond said lower end;

a shaft retainer secured to the pole member at a region intermediate the upper end and annular golf club support, said retainer being dimensioned for releasably receiving said supported club shafts in said annular array; and a counterweight secured to said support and to said pole member in said pole member core and in said tubular member bore at said lower end for providing a center of gravity for said stand and carried clubs at a position intermediate said retainer and annular golf club support.

2. The caddy of claim 1 wherein said projection member includes means for releasably receiving an axially extending spike for securing the caddy in earth.

3. The caddy of claim 1 wherein said support comprises a disk having said receptacles, said depending tubular member being central said disk for supporting said caddy in an upright orientation.

4. The caddy of claim 3 further including a spike and wherein the tubular member bore has an upper portion of a first diameter for receiving the pole member and a smaller diameter lower portion for releasably receiving the spike, said counterweight being received in said pole member core coextensive with at least the upper portion of the bore.

5. The caddy of claim 4 wherein the counterweight comprises a bolt, said tubular member bore having a shoulder between said upper and lower portions, said bolt and pole member abutting said shoulder.

6. The caddy of claim 5 wherein the bolt has a shaft and a head, said head abutting said shoulder, said shaft extending in and beyond the support in the pole member core.

7. The caddy of claim 1 wherein the support and retainer are each one piece molded thermoplastic.

8. The caddy of claim 1 including a carrying handle fixedly secured to the pole member in a medial region of the pole member, the caddy and the carried clubs having a center of gravity approximately at said medial region.

9. The caddy of claim 1 including a resilient hand grip at said pole member upper end.

10. The caddy of claim 1 including a plurality of tee receiving rubber grommets in said retainer.

11. The caddy of claim 1 including an axially extending array of golf ball clips secured to the pole member intermediate said retainer and annular golf club support, each clip for resiliently securing golf ball.

12. The caddy of claim 11 including a handle for carrying the caddy, said handle extending in the axial direction aligned with the golf ball clips.

13. The caddy of claim 12 including a spike threaded to the support in a first orientation for securing the caddy to earth in an active mode and a threaded hole in the support for securing the spike to the support in a quiescent second orientation.

14. The caddy of claim 1 wherein the grip ends of at least two of the golf clubs have different dimensions, said receptacles being dimensioned to receive corresponding dimensioned club grip ends.

15. A golf club carrier and stand caddy for carrying a plurality of golf clubs, the golf clubs each comprising a shaft having a grip end and a head end, said caddy comprising:

a pole member extending in an axial direction and having upper and lower ends, at least the lower end having a hollow core;

a rubber grip secured to the pole member at the upper end;

an annular golf club thermoplastic disk support secured to and extending radially outwardly from the pole member adjacent to the lower end, said support having an annular array of axially directed cup receptacles depending therefrom, each receptacle for receiving and supporting the grip end of a shaft, said array being positioned circumferentially about the pole member, said annular thermoplastic disk support including a central depending support member extending axially beyond said receptacles and away from said lower pole member end, said support member having an axial bore for receiving said pole member lower end;

a thermoplastic disk club shaft retainer secured to the pole member at a region intermediate the upper end and disk support including a plurality of golf club securing clips for releasably receiving said supported club shafts in said annular array;

a counterweight secured to said disk support in said depending support member bore and in said pole member core at said lower end for providing a center of gravity for said stand and carried clubs intermediate said retainer and disk support; and a handle fixedly secured to the pole member approximately at said center of gravity.

16. The caddy of claim 15 wherein said depending support member depends below said receptacles for supporting said caddy upright parallel to the force of gravity in a quiescent mode.

17. The caddy of claim 16 including a caddy support spike threaded at one end, said projecting member and support each including thread means for releasably receiving the spike in respective active earth securing and quiescent modes.

* * * * *